United States Patent [19]

McNinch, Jr. et al.

[11] Patent Number: 4,592,678

[45] Date of Patent: Jun. 3, 1986

[54] MODULAR BLOCK RETAINING WALL

[76] Inventors: Edwin K. McNinch, Jr., 5225 Wooster Ave., San Mateo, Calif. 94403; James E. McNinch, 1404 Floribunda Ave., Burlingame, Calif. 94010

[21] Appl. No.: 609,768

[22] Filed: May 14, 1984

[51] Int. Cl.[4] ..... E02D 29/02

[52] U.S. Cl. ..... 405/284; 405/229; 405/286

[58] Field of Search ..... 405/272, 273, 284, 285, 405/286, 229, 287

[56] References Cited

U.S. PATENT DOCUMENTS

| | | | |
|---|---|---|---|
| 996,843 | 7/1911 | Francisco | 405/285 |
| 1,002,161 | 8/1911 | Lambert | 405/286 |
| 3,269,125 | 8/1966 | Moore | 405/286 X |
| 3,953,979 | 5/1976 | Kurise . | |
| 4,081,969 | 4/1978 | Clark . | |
| 4,193,718 | 3/1980 | Wahrendorf et al. | 405/286 |
| 4,229,123 | 10/1980 | Heinzmann | 405/273 |
| 4,293,245 | 10/1981 | Jaecklin | 405/284 X |
| 4,312,606 | 1/1982 | Sarikelle | 405/286 |
| 4,426,176 | 1/1984 | Terada | 405/285 |

*Primary Examiner*—David H. Corbin

*Attorney, Agent, or Firm*—Robert R. Tipton

[57] ABSTRACT

A retaining wall utilizes an ordered array of modular blocks each having a horizontal cross-section defining a double "T" shape, the top of the double "T" defining a vertical planar member having a horizontal length greater than the vertical height with the stem of each "T" defining a generally planar leg member having a height the same as the vertical planar member. A hole is provided vertically through each leg distal the vertical planar member and adapted to receive a tension rod for tying the assembled blocks together. The "T" shaped blocks are vertically arranged in staggered courses with the holes of the legs in the course above vertically aligned with the holes in the legs in the course below. The lower end of the tension rod is adapted to be anchored in the concrete footing supporting the retaining wall. The wall is assembled first by setting block supports on a graded area to elevate the first course of blocks above the ground, installing a first course of blocks on the elevated supports with tension rods installed in the holes in the legs of the blocks, the tension rod including an adjustable elevation support, placing additional courses of blocks in staggered array using the tension rods as guides in cooperation with the holes in the legs for setting the remaining blocks in place.

3 Claims, 8 Drawing Figures

MODULAR BLOCK RETAINING WALL

BACKGROUND OF THE PRIOR ART

The reinforced retaining walls of the prior art utilized various configurations of modular blocks. The components of these prior art wall utilized various shapes and sizes of modular blocks which were capable of being assembled in several different arrangements to form a crib or bin type of wall with interconnecting parts. The weight of the fill material bearing on the wall was used to keep the wall in place.

Other walls utilized special shaped blocks designed to interlock and be held in place by tension members along the centerline of the wall.

Still other retaining walls utilized other shapes of interlocking blocks having vertical holes therein which were then dropped in place using reinforcing rods passing though the holes after the reinforcing rods were first imbedded in a concrete footing.

Still other retaining walls utilized stacked and alternately staggered rows of chevron shaped or grooved blocks which were also connected to anchoring devices embedded in the backfill along one side of the wall.

In the retaining walls of the prior art the main methods of preventing overturning of the wall were to provide one or more anchors extending horizontally into the ground or soil being held back or retained by the wall, construct a crib or bin of considerable thickness or slope the face of the wall so that horizontal earth pressures were reduced. The weight of the earth was then used to counteract any overturning moment by forces acting at right angles to the wall.

One free-standing retaining wall of the prior art utilizes large concrete blocks which must be handled by barges or derricks and a rod passing down through the center of the wall. In this wall the large size of the concrete blocks is utilized to resist overturning moments.

These retaining walls of the prior art generally required excessive excavation for their installation, large machinery or special skill or strength and know-how in their construction and assembly.

SUMMARY OF THE INVENTION

The purpose of the present invention is to provide a vertical retaining wall similar in appearance and structural function to a conventional concrete block wall but much simpler to construct. The construction of the retaining wall according to the present invention eliminates the need for a. laying out and securing of reinforcing steel by anchoring it to a form or template.

b. footing forms or footing layout.

c. waiting for the footing concrete to strengthen before setting concrete blocks in place.

d. filling the cells of concrete blocks with concrete.

e. mortared joints.

Thus it can be seen that the time and skills required to construct the wall of the present invention are substantially less than the time and skills required to build a conventional concrete block wall or any of the walls of the prior art.

This is accomplished by utilizing an ordered array of lightweight modular blocks, each having a horizontal cross-section defining a double "T" shape the top of the double "T" defining a vertical planar member typically having a horizontal length greater than the vertical height, the stem of each "T" defining a generally planar leg member having a height equal to the height of the vertical planar member, each leg member having a hole vertically therethrough distal the vertical planar member and having its longitudinal axis disposed vertically through the leg, the hole being adapted to receive a tension member, the double "T" shaped blocks being arranged vertically in staggered courses with the holes of each leg being vertically aligned with the hole in the leg in the course below and the ends of each planar member abutting each other.

The process of the invention includes the steps of grading, to a generally flat surface, the ground area proximate location of the retaining wall; placing on that graded surface various means for supporting and elevating the first course of modular blocks above the surface of the ground; inserting an elongated tension/reinforcing support member into the hole in each leg of the first course of modular blocks, the lower end of the elongated tension/reinforcing support member being provided with an adjustable elevation support and means bearing against the underside of the first course modular block; then placing the first course of modular blocks on the supports in an ordered array with ends abutting with additional blocks placed in vertical staggered courses, the holes in each leg vertically aligned with the holes in each leg in the course below using the elongated tension/reinforcing support members as guides; applying and maintaining tension in the elongated tension member to hold the assembled blocks together; then pouring a concrete footing under the stacked array of modular blocks whereby the lower end of the elongated tension/reinforcing support member is embedded and anchored in the concrete, the concrete being poured to support the wall; the tensioned elongated member serving as an anchor for the wall and also as a tensile element for counteracting any overturning moments.

The step of inserting the elongated tension member through the holes in the legs can be performed after the blocks are set in place, however, a separate adjustable elevation support will be required under each leg of the modular block in order to elevate the first course of blocks above the ground.

It is, therefore, an object of the present invention to provide a retaining wall utilizing lightweight modular blocks, the assembled wall having high resistance to overturning moments.

It is another object of the present invention to provide a retaining wall utilizing lightweight modular blocks having a horizontal cross-section defining a double "T" shape.

It is still a further object of the present invention to provide a retaining wall utilizing lightweight modular blocks in which a tension member is used which passes through the vertically aligned leg members, the tension member being located a predetermined distance away from the center of gravity of the wall section.

It is also another object of the present invention to provide a retaining wall in which the tension member passing through the vertically aligned leg members further functions to initially support the leg members in the bottom course of blocks above the ground prior to pouring the concrete footing for the wall.

It is a further object of the present invention to provide a method of constructing a retaining wall utilizing modular blocks having a horizontal cross-section defining a double "T" shape in which the foundation is poured after the modular blocks have been set in place.

These and other objects of the present invention will become manifest upon study of the following detailed description when taken together with the drawings.

DESCRIPTION OF THE PREFERRED EMBODIMENT

Figure 1:
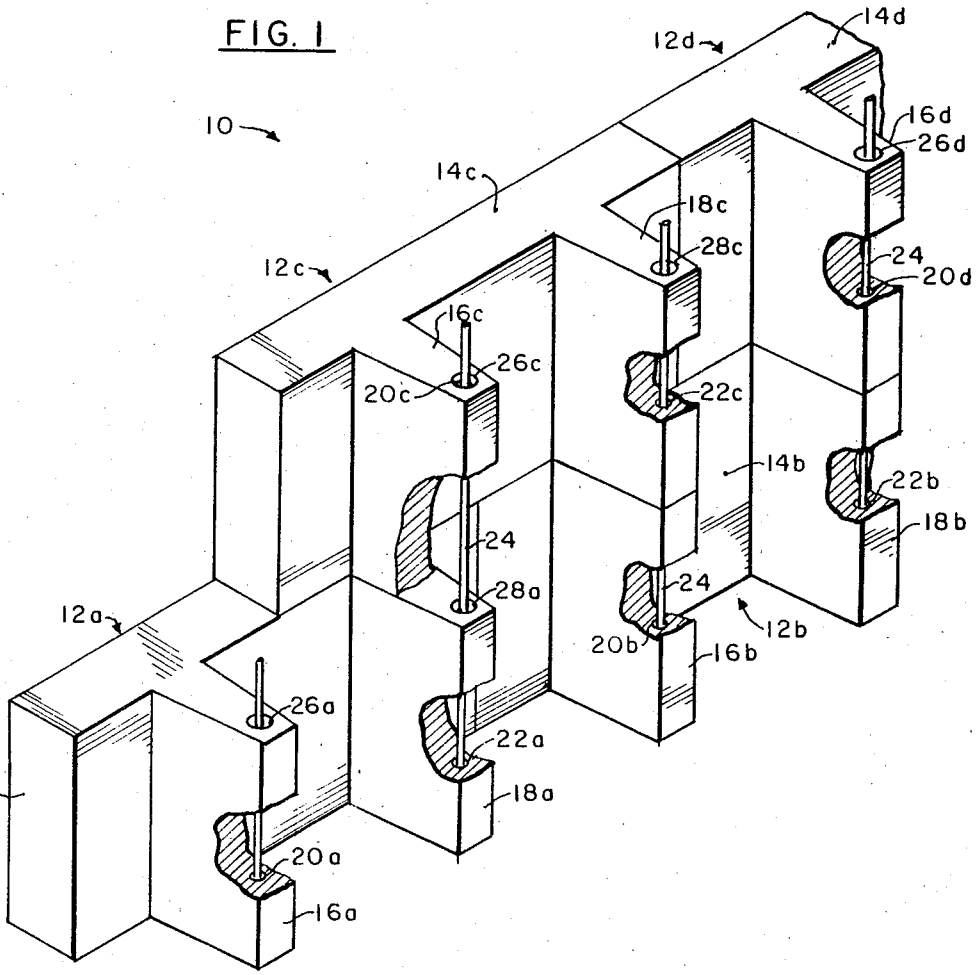
FIG. 1 is an isometric view of the typical retaining wall of the present invention utilizing an ordered array of modular blocks having a horizontal cross-section defining a double "T" shape.

With reference to FIG. 1 there is illustrated the typical modular block retaining wall 10 of the present invention comprising, basically, an ordered array of individual modular blocks 12 (12*a*, 12*b*, 12*c* and 12*d*) vertically arranged in staggered courses the first course comprising modular blocks 12*a* and 12*b*. The second course comprises modular blocks 12*c* and 12*d*.

Each modular block 12 has a horizontal cross-section defining a double "T" shape the top of the double "T" defining a vertical planar member 14 (14*a*, 14*b*, 14*c* and 14*d*) typically having a horizontal length greater than its vertical height with the stem of each "T" defining a first generally planar leg member 16 (16*a*, 16*b*, 16*c* and 16*d*) and a second generally planar leg member 18 (18*a*, 18*b*, 18*c* and 18*d*).

Each of the legs 16 and 18 further comprises means defining a hole 20 and 22 (20*a*, 20*b*, 20*c*, 20*d* and 22*a*, 22*b*, 22*c* and 22*d*), respectively, proximate the end of the leg distal the vertical planar member 12 and having a longitudinal axis disposed vertically through the legs. In addition, each leg is located, respectively, one-quarter of the length of vertical planar member 14 from each end of the planar member.

As shown in FIG. 1, modular blocks 12 are placed with ends abutting each other and in staggered courses whereby leg 18 (18*a*, 18*b*) of blocks 12*a* and 12*b*, respectively, are located directly under legs 16 (16*d* and 16*c*) of blocks 12*c* and 12*d*, respectively, so that holes 22 (22*a* and 22*b*) are aligned with holes 20 (20*c* and 20*d*).

Alignment of holes 20 and 22 is assisted when elongated tension member 24 are first installed in holes 20 and 22 when the bottom course of blocks 12 are installed. Tension member 24 can then be used as a guide in cooperation with holes 20 and 22 when dropping or setting the blocks in place.

Figure 3:
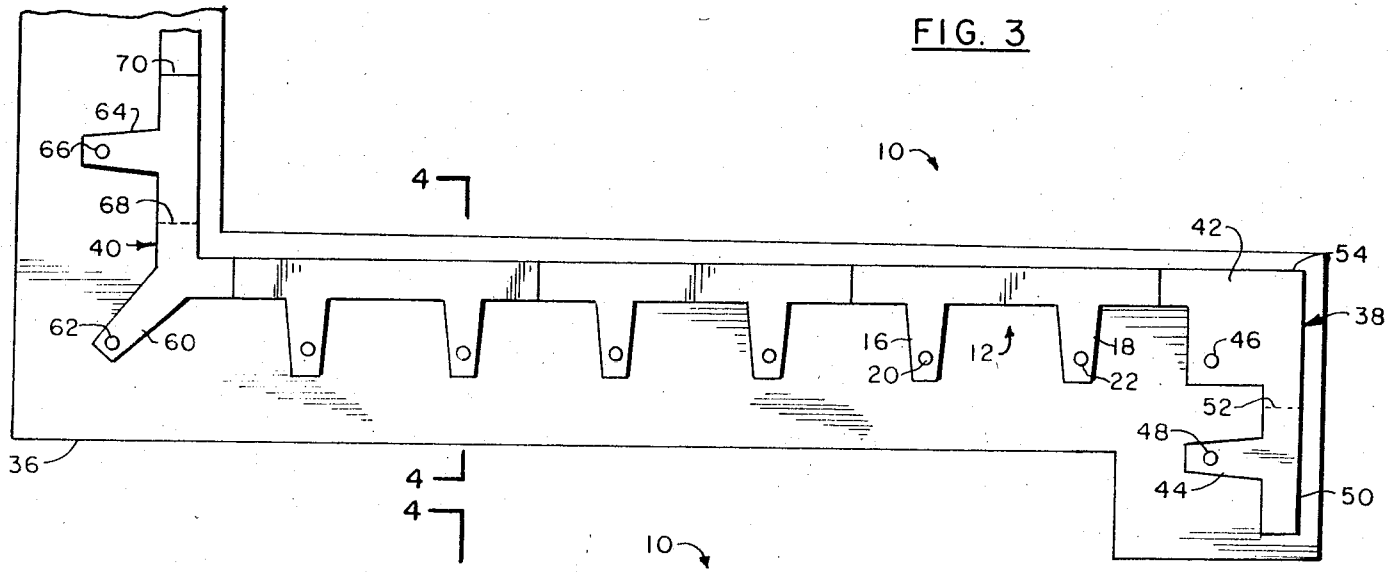
FIG. 3 is a plan view of the typical modular block retaining wall illustrated in FIG. 2 further illustrating the use of inside and outside corner block arrangements.
Figure 2:
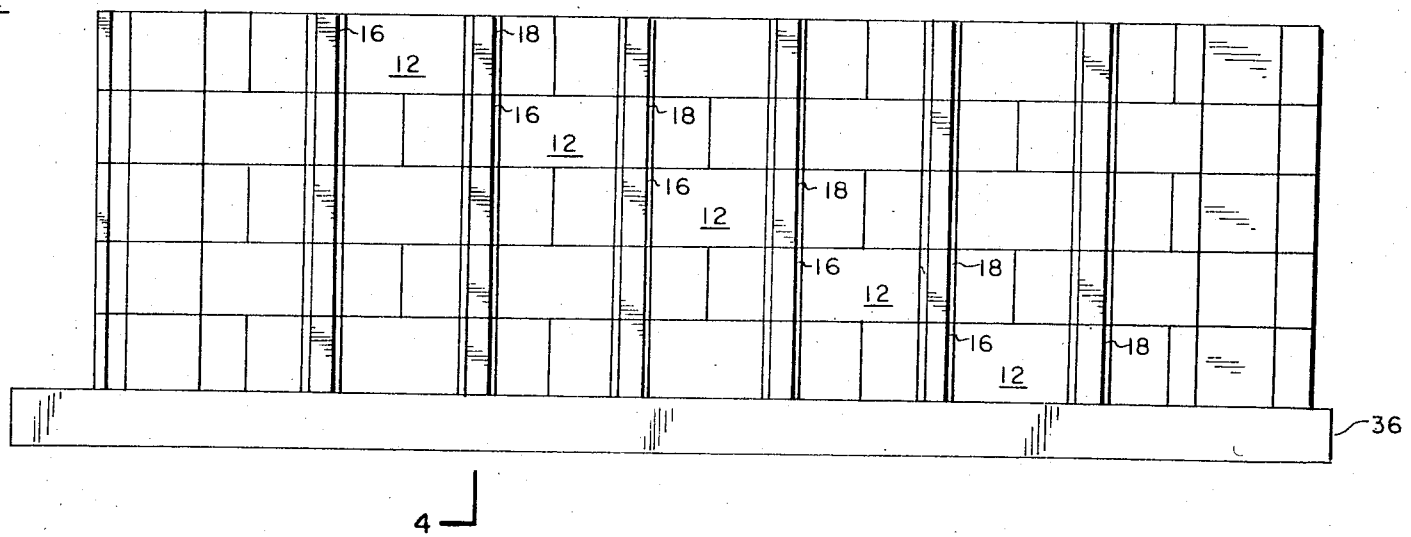
FIG. 2 is an elevational view of the back of a typical retaining wall of the present invention.

With reference to FIGS. 2 and 3 there is illustrated a typical modular block retaining wall 10 of the present invention arranged as a 5 tier block wall resting on a foundation 36.

In FIG. 2, a representative sample of five blocks have been identified to show the staggered position of the blocks and the relationship between legs 16 and 18 in one tier relative to corresponding leg 16 and 18 in the tier below.

With respect to FIG. 3, there is illustrated a plan view of the modular block wall of FIG. 2 showing typical outside corner block 38 and inside corner block 40.

Typically, outside corner block 38 comprises a corner portion 42 and a leg portion 44, the corner and leg portion each having a hole 46 and 48, respectively, arranged in the same modular position as holes 20 and 22 of a typical straight modular block 12.

In FIG. 3 the typical top outside corner block 38 is shown. The corner block in the next course below comprises the same corner section 42, however, leg member 44 and its corresponding vertical planar section would be reversed from the block above. The vertical planar member of the block below is shown ending at dotted line 52 which is half the distance to the front face 54 of wall 10. This will allow a standard straight modular block 12 to be installed below top block 38 to permit the wall to be extended as desired.

With respect to inside corner block 40, this block comprises a corner leg 60 having a hole 62 therein to receive an elongated tension member 24 and a second leg 64 having a hole 66 therethrough also to receive a typical elongated tension member 24. Holes 62 and 64 are spaced in the same modular arrangement as for a straight block 12.

Inside corner block 40, shown in FIG. 3, illustrates the top block configuration. The corner block configuration for the course below top block 40 will be the reverse of top block 40 and will end at dashed line 68 which is one half the length of a typical block 12 from end 70 of top block 40. Similar to the case for outside corner block 38, this will permit a typical block 12 to be installed in the second tier below top corner block 40 for continuation of the staggered block arrangement of the wall in the direction shown.

Figure 4:
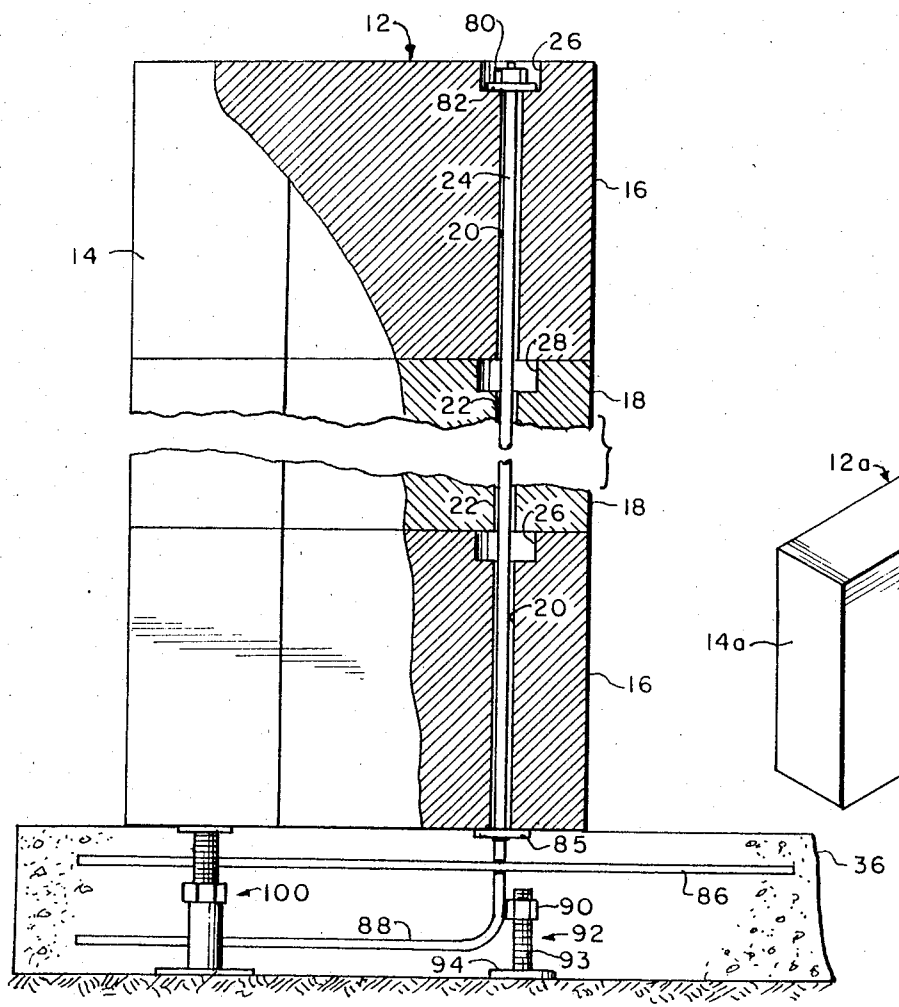
FIG. 4 is a partial cross-sectional elevational view of the modular block retaining wall of the present invention taken at lines 4—4 of FIGS. 2 and 3.

With respect to FIG. 4 there is illustrated a cross-sectional elevational view of the wall illustrated in FIGS. 2 and 3 taken at lines 4—4.

Here again typical modular block 12 is stacked in vertically with hole 20 in the course above aligned with hole 22 in the block of the course below.

It will be noted that the top of each block is provided with a first recess 26 at hole 20 and a second recess 28 at hole 22. As can be seen in FIG. 4, the recess at the top of block 12 at the top course is adapted to receive nut 80 and washer 82 which are used to apply tension to elongated tension member 24 passing though holes 20 and 22.

Elongated tension member 24 is, or course, provided with threads at its upper portion for receiving nut 80.

By recessing nut 80 into block 12, a capper piece (not shown) or layer of mortar can be applied to the top of the wall to create a finished surface.

The lower end of elongated tension member 24 further comprises an adjustable elevation support comprising a nut or internally threaded pipe 90 attached to the lower end of elongated tension member 24, as by welding or the like, and adapted to receive threaded member 93 of support 92. Support plate 94 is attached to threaded member 93 and is adapted to bear against the surface of the ground or graded area.

Figure 5:
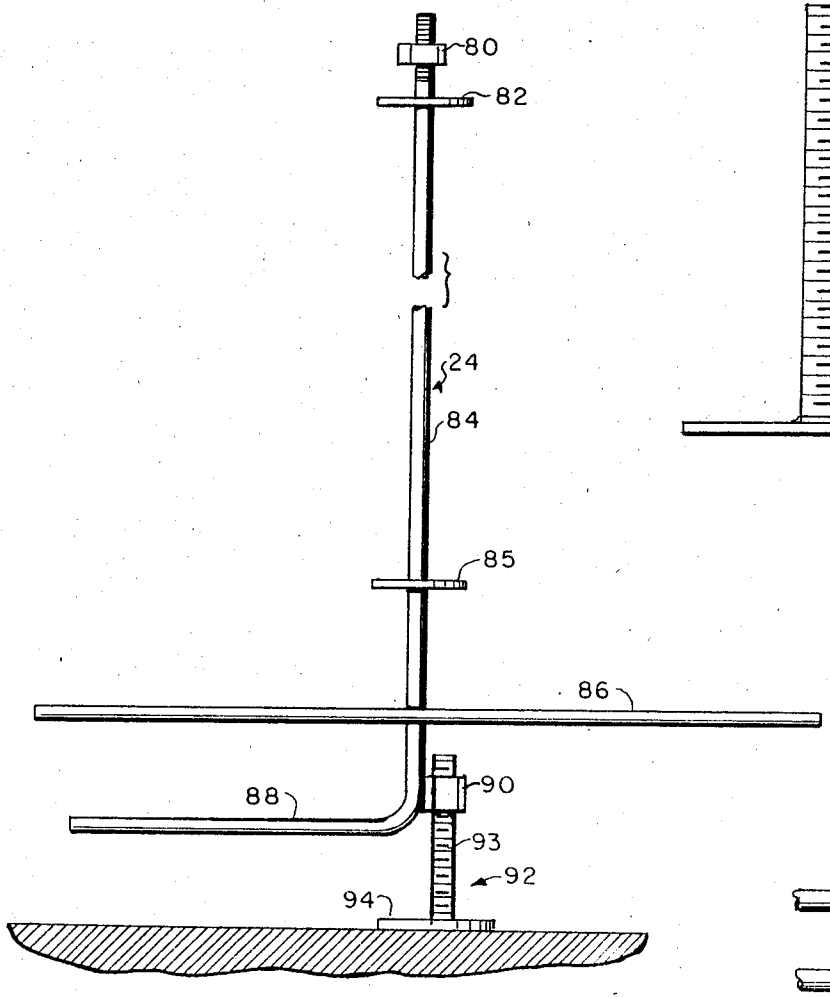
FIG. 5 is a detailed illustration of the combined elongated tension member and anchor, block support and footing reinforcing bar used to connect the modular blocks together, to level the blocks before placement of the footing concrete and to provide tensile reinforcing in the concrete footing after the concrete footing has been placed.

With reference to FIG. 5 there is illustrated a detailed illustration of elongated tension member 24 of the present invention used to support modular blocks 12 prior to pouring concrete footing 36 and to counteract any overturning moment applied to assembled modular block retaining wall 10.

One of the advantages offered by elongated tension member 24 is the saving in time by elimination of the need for laying out and securing reinforcing steel to a form or template.

Elongated tension member 24 comprises, basically, straight portion 84 having an upper end provided with threads which are adapted to receive a washer 82 and nut 80 and a rigid elongated member 86 attached, as by welding or the like, to its lower end extending a predetermined distance perpendicular to straight portion 84 on either side of straight portion 84. Rigid elongated member 86 thus acts as tensile reinforcing steel in foundation 36 as shown in FIG. 4.

The lower portion of elongated extension member 24 further comprises a washer or disk 85 attached, as by welding or the like, to straight portion 84 and adapted to engage and support the underside of the first course of modular blocks 12 of retaining wall 10 prior to placement of the footing concrete.

Proximate the lower end of straight portion 84, is attached, as by welding or the like, internally threaded pipe or nut 90. Nut 90 is adapted to receive adjustable support member 92.

Extending horizontally from the lower end of straight portion 84 is tension reinforcing member 88 which provides tension reinforcing in the concrete foundation slab 36 (FIG. 4) under wall 10 as well as serve as an anchor for elongated tension member 24.

Figure 6:
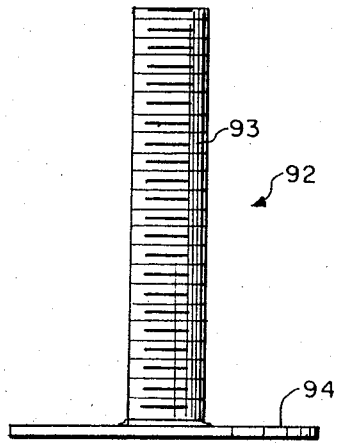
FIG. 6 is a detailed illustration an adjustable support apparatus for the longitudinal extension member and footing reinforcing bar.

With reference to FIG. 6, adjustable support member 92 is provided with a threaded member 93 attached, as by welding or the like, to base plate 94 which is adapted to bear on the earth under foundation 36 to keep blocks 12 and wall 10 supported in a true vertical position and to keep rigid member 86 and reinforcing tension member 88 properly spaced in concrete foundation 36 when it is poured.

Figure 7:
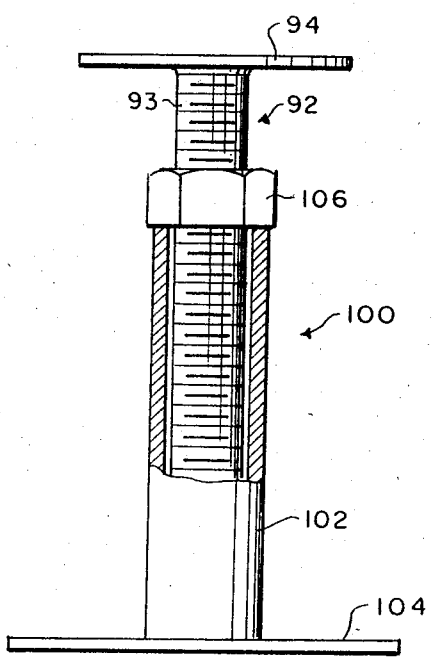
FIG. 7 is elevational view of a typical adjustable block support.

With reference to FIG. 7 there is illustrated a typical modular block adjustable support 100 comprising a pipe support section 102 attached to a base plate 104.

Pipe 102 is adapted to receive adjustable support 92 with its attached base plate 94. A nut 106 is adapted to receive threaded adjustable support member 92 with nut 106 bearing on the top of pipe 102. By holding adjustable support member 92 stationery and rotating nut 106, base plate 94 can be raised or lowered as necessary to vary both the elevation of the block and its vertical alignment in cooperation with other block supports.

Figure 8:
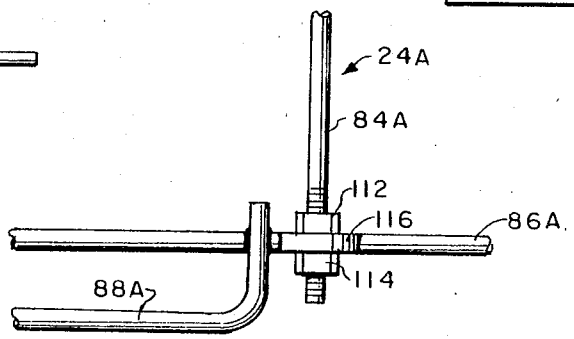
FIG. 8 is an illustration of a further embodiment of the elongated tension member and anchor and method of construction where the elongated tension member is installed after the modular blocks are set in place.

In the event that elongated tension member 24 with its adjustable support member 92 in combination with washer 85 is not used, FIG. 8 illustrates a further embodiment of elongated tension member 24 identified as elongated tension member 24A in which the lower portion of elongated tension member 24A is provided with rigid elongated member 86A which now defines a separate element attached to the lower end of straight portion 84A. As shown in FIG. 8, nuts 112 and 114 are placed on the lower end of straight portion 84A and are used to engage washer 116 which is attached to rigid elongated member 86A as by welding or the like.

Reinforcing tensile member 88A is also attached to rigid elongated member 86A as by welding or the like to achieve a structure similar to that shown in FIG. 5.

To assemble the wall of the present invention, the ground upon which the wall is to be erected is graded to a generally flat surface.

Block supports 100 are then placed on the graded surface to support each end of vertical planar member 14 of block 12. Elongated tension members 24 are then inserted into holes 20 and 22 in legs 16 and 18, respectively, of block 12 with washer 85 engaging and supporting the underside of block 12.

Modular blocks 12 are then placed on supports 100 and 92 with ends abutting to define a first tier or course.

Corner or end blocks are placed as required and a second course of modular blocks 12 is assembled on top of the first course of modular blocks staggered so that legs 16 of the second course are aligned with legs 18 of the first course as are holes 20 of the second course aligned with holes 22 of the first course using elongated tension members 24 as guides.

Additional courses are added in a similar manner.

With all elongated tension members in place and with rigid elongated member 86 extending generally perpendicular to the plane of the wall, concrete is then poured into the excavated area under the assembled blocks and allowed to fill the excavated area up to the underside of the first course of blocks.

After the concrete has set, nut or tensioning means 80 is connected to the top end of elongated tension member 24 and tightened to create a tension is straight portion 84.

With all tension members 24 maintained in tension, back filling can now take place to cover legs 16 and 18.

It can be seen that rigid elongated member 88 provides an anchoring means for elongated tension member 24. It can also be seen that reinforcing member 86 provides additional tension reinforcing in foundation 36 to further counteract the tension forces created in slab or foundation 36 by the overturning moment applied to wall 10 from the backfill behind modular block retaining wall 10.

If elongated tension member 24A illustrated in FIG. 8 is used, then that particular elongated tension member can be installed after blocks 12 are all set in place with holes 20 and 22 aligned as described above.

Rigid elongated member 86A is then attached to the lower end of elongated tension member 24A using nuts 112 and 116 engaging the bottom end of straight portion 84A of elongated tension member 24A in cooperation with washer 116 which is welded to rigid elongated member 86A.

Thus a modular block retaining wall can be constructed with a minimum of effort and skill which has structural advantages over other retaining walls.

In particular, the retaining wall of the present invention can be constructed without the need for: a. laying out and securing of reinforcing steel by anchoring it to a form or template; b. footings or forms; c. waiting for the footing concrete to strengthen before placing the concrete blocks; d. filling the cells of the blocks with concrete; or e. motaring the joints.

We claim:

1. A retaining wall comprising an ordered array of modular blocks each having a horizontal cross-section defining a double "T" shape the top of said "T" defining a vertical planar member having the stem of each "T" defining a generally planar leg member having a height equal to the height of said vertical planar member, said leg members each disposed from opposite ends of said vertical planar member a distance of one-quarter of the length of said vertical planar member, each of said legs comprising means defining a hole proximate the end of said leg distal said vertical planar member and having a longitudinal axis disposed vertically through said leg, said double "T" shaped block vertically arranged in staggered courses with said holes in said legs vertically aligned with the holes in the legs of the course above, and the ends of said vertical planar members abutting each other, and means adapted to be received in said holes for connecting said modular blocks together said means comprising a reinforcing member comprising a generally straight vertical tension arm adapted to be received in said hole in said said leg member of said modular block and projecting vertically through said modular blocks, a generally straight horizontal base reinforcing arm disposed at right angles to said generally straight tension member and projecting horizontally under said wall in a direction generally perpendicular to said wall, a bracket attached to said vertically disposed tension arm for supporting said modular blocks, means connected to said vertical tension arm for adjusting the elevation of said base reinforcing arm above a supporting surface prior to pouring a concrete footing under said modular blocks.

2. A method of constructing a retaining wall comprising the steps of grading the ground area proximate the location of said retaining wall to define a generally flat surface, placing, on said generally flat surface, a means having a support bracket for supporting above said generally flat surface a plurality of modular blocks having a horizontal cross-section defining a double "T" shape, the top of said double "T" defining a vertical planar member having the stem of each "T" defining generally planar leg member having a height equal to the height of said vertical planar member, each leg member having means defining a hole therein proximate the end thereof distal said vertical planar member and having a longitudinal axis disposed vertically through said leg, inserting an elongated tension support member, attached to said support bracket, through said holes in said modular block, said elongated tension support member adapted to be adjustable as to height and to support the bottom course of modular blocks proximate said leg members, placing on said supporting means in an ordered array, said modular blocks with the ends of said vertical planar members abutting each other, vertically aligned in staggered courses and with said holes in said legs vertically aligned with the holes in said legs in the course below and using said vertical elongated tension member as a guide, pouring a concrete footing under said stacked array of modular blocks whereby said wall is supported on said concrete footing and said means having a support bracket for supporting said blocks above said surface is imbedded in said concrete, and applying and maintaining tension on said elongated tension member.

3. The method of constructing a retaining wall as claimed in claim 2 wherein said step of inserting an elongated tension member through said holes in said legs and attaching it to said support bracket is performed after all of said modular blocks are set in place and before the concrete is poured under the stacked array of modular blocks.

* * * * *